United States Patent [19]

Blanchard

[11] 4,346,958

[45] Aug. 31, 1982

[54] CONNECTOR FOR CO-AXIAL CABLE

[75] Inventor: Clayton H. Blanchard, Horseheads, N.Y.

[73] Assignee: LRC Electronics, Inc., Horseheads, N.Y.

[21] Appl. No.: 199,963

[22] Filed: Oct. 23, 1980

[51] Int. Cl.[3] ..... H01R 13/36

[52] U.S. Cl. ..... 339/177 R

[58] Field of Search ..... 339/177, 268

[56] References Cited

U.S. PATENT DOCUMENTS

| | | | |
|---|---|---|---|
| 3,757,279 | 9/1973 | Winston | 339/177 R |
| 3,854,789 | 12/1974 | Kaplan | 339/177 R |
| 3,879,102 | 4/1975 | Horak | 339/177 R |

FOREIGN PATENT DOCUMENTS

| | | | |
|---|---|---|---|
| 1242731 | 6/1967 | Fed. Rep. of Germany | 339/177 R |
| 1958357 | 6/1970 | Fed. Rep. of Germany | 339/177 R |

*Primary Examiner*—Joseph H. McGlynn
*Attorney, Agent, or Firm*—Weingarten, Schurgin & Gagnebin

[57] ABSTRACT

An integral mandrel connector for co-axial cable. The connector has two major assemblies which telescope together and grip the prepared end of the cable. Elements of the connector tighten on the cable jacket and grip the cable center conductor, all simultaneously, when the two threaded assemblies are engaged and tightened together. A collar inside one assembly moves axially a short distance upon tightening of the assemblies to cause a chuck to grip the center conductor while the cable jacket is also being positively gripped by other connector elements. The connector can be employed for splicing two pieces of cable together, for adapting cable of one size to a different size cable, and for coupling to external equipment such as an amplifier.

13 Claims, 5 Drawing Figures

CONNECTOR FOR CO-AXIAL CABLE

FIELD OF THE INVENTION

This invention relates generally to electrical connecting devices and more particularly concerns a connector for co-axial cable which is simplified in construction and positive in operation.

DISCUSSION OF THE PRIOR ART

In the community antenna television (CATV) industry, it is necessary to couple co-axial cable to other devices such as other pieces of cable, amplifiers, splitters and junction boxes which may be located at either end of a run of cable or at any other location therebetween. It is imperative that such connectors engage the cable jacket and the center conductor in a positive manner both mechanically and electrically so that there is no appreciable signal attenuation caused by such connector, while at the same time the connector insulates the connection against radio frequency interference (RFI) and against egress or radiation of the signal transmitted by the cable.

A typical known connector used in the CATV industry comprises three major assemblies. The forward assembly includes a terminal and chuck wherein the chuck is located within an entry barrel and the terminal projects outwardly therefrom. The end of the barrel opposite the terminal is threaded to engage cooperating threads on a center housing assembly. The center housing includes a collar with a tapered internal opening for engaging the chuck at one end and at the other end a thin-walled cylindrical mandrel which fits between the jacket, typically made of metal, and the insulating material of the co-axial cable, that is, inside the cable jacket. A clamp nut assembly including a ferrule is secured to the other end of the center housing. The ferrule combines with the center housing to clamp the jacket of the cable into the connector. The center conductor is gripped by the chuck in the forward assembly. It should be noted that after preparation of the cable, the three-element connector of the prior art requires four basic assembly steps to mount the connector to the cable: the clamp nut is slipped over the cable end; the mandrel is slid into the cable; the lock nut is tightened onto the center housing to hold the cable; and then the center housing and forward assembly are coupled to grip the cable center in the chuck.

In addition to the number of parts and assembly steps involved, typical prior art conenctors have to provide an internal cushion member to prevent the cable jacket, after being inserted into the center housing, from expanding or ballooning upon tightening of the clamp nut. Also because of the length by which the center conductors have to extend from the insulation after preparation, field installation is somewhat difficult because of the distance the cable itself must be physically pulled back or moved longitudinally to insert a connector. Further, prior art connectors of this type often applied a torque to the center conductor upon final tightening when the conductor was firmly gripped by the chuck, so provisions such as keying for rotational alignment were necessary, thereby complicating the connector structure, assembly and operation.

SUMMARY OF THE INVENTION

The connector of the present invention is substantially simplified in that only three assembly steps are necessary to couple the cable and the connector. Other advantages relate to manufacturing and assembly costs, in that there are only two major assemblies of the present connector comprised of 12 parts, while the prior art device includes 16 parts in three major assemblies. Thus the present connector is simpler to manufacture and assemble with commensurate cost savings, thereby providing significant advantages to the industry. Additionally, since the gripping of the center conductor and tightening of the connector on the cable jacket are accomplished simultaneously, the present invention offers unexpected advantages in the cooperative mating of the assemblies and parts therein. Another significant feature is that upon assembly to the cable there is no torque applied to the center conductor of the cable, a common problem with prior art connectors. Still another advantage of this connector is that the cable has a shorter preparation, that is, the length by which the center conductor extends beyond the insulation, offering ease of installation in the field since the cable need not be bowed as much or longitudinally pulled back as far after it is in place, in order to attach one of the connectors of this invention.

The entry barrel of one embodiment of the present connector comprises a terminal extending from one end thereof and a chuck located within the barrel. A mandrel which fits between the cable insulator and jacket extends from the other end and is mounted in fixed position within the entry barrel. A collar is coupled to a pusher member and is adapted to move axially with respect to the mandrel to cause the chuck to grip the center conductor of the cable. The clamp nut assembly includes a ferrule which extends over the mandrel in the entry barrel assembly and has an external tapered portion which mates with an internal tapered portion in the barrel assembly to cause the ferrule to close radially onto the jacket of the cable when the clamp nut assembly is tightened onto the entry barrel assembly. One end of the ferrule engages the pusher member to move the collar axially to actuate the chuck.

The connector may be modified so that the connector can function as an adaptor for different size cables or as a splice for the same size cable, as well as the coupling mentioned above.

BRIEF DESCRIPTION OF THE DRAWING

The objects, advantages and features of this invention will be more easily perceived from the following detailed description when read in conjunction with the accompanying drawing in which.

DESCRIPTION OF THE PREFERRED EMBODIMENT

Figure 1:
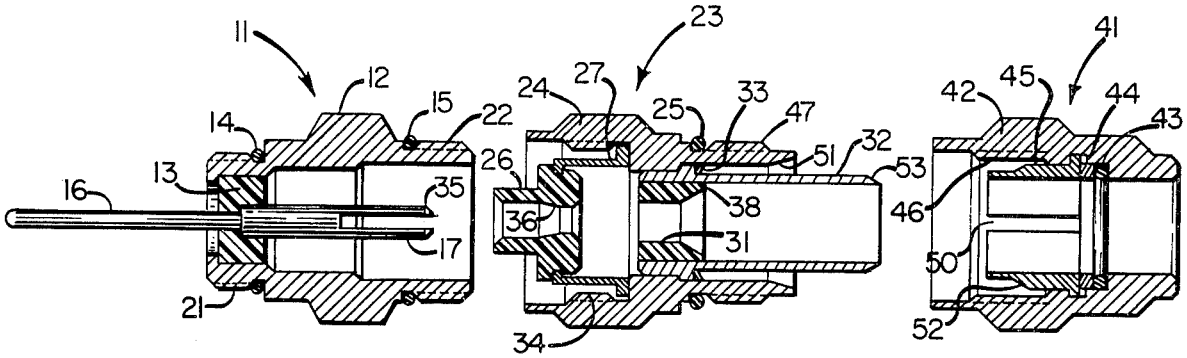
FIG. 1 PRIOR ART.
FIG. 1 is an exploded sectional view of a prior art connector.

With reference now to the drawing and more particularly to FIG. 1 thereof, there is shown a prior art connector comprised of three assemblies. The entry barrel assembly 11 comprises entry barrel 12, insulator 13, O-rings 14 and 15, terminal 16 and chuck 17. The terminal and chuck are typically made of a single piece of electrically conductive material. The entry barrel has forward threads 21 and rearward threads 22. The chuck and terminal are mounted to the entry barrel through insulator 13. Threads 21 are adapted to mate with a housing entry port of conventional design which receives and makes electrical connection with terminal 16. O-ring 14 provides a seal for this connection.

Center housing assembly 23 is comprised of center housing 24, O-ring 25, collar 26, follower 27, support insulator 31, supporting mandrel 32 and plastic seal 33. The center housing is formed with internal threads 34 which mate with threads 22 on entry barrel 12. O-ring 15 on the entry barrel provides a seal between the entry barrel and the center housing assembly. It should be noted that follower 27 is allowed a slight axial motion within center housing 24 and engages collar 26 and holds it in position to mate with and close chuck 17. Chuck 17 is formed with externally beveled surface 35 and collar 26 is formed with mating internally beveled surface 36 so that when the collar is forced onto the chuck, the mating beveled surfaces cause the chuck to close. Mandrel 32 is adapted to extend between the co-axial cable insulation and the jacket of the cable to provide support for the jacket. Support insulator 31 provides a funnel entry for the extending center conductor of the cable when the cable is mounted to the center housing assembly. Plastic seal 33 is in the shape of a cupped washer and provides a cushion to prevent expanding or ballooning the cable jacket when the cable is clamped to the connector, since there is some forward (left in FIG. 1) motion of the cable upon final tightening.

The clamp nut assembly 41 is comprised of clamp nut 42, O-ring 43, carrier 44 and ferrule 45. The clamp nut is formed with internal threads 46 which mate with external threads 47 on the center housing. O-ring 25 provides a seal between the clamp nut and the center housing. Internal beveled surface 51 on the center housing mates with external beveled surface 52 on the ferrule to cause the ferrule to be reduced in radial dimension upon engagement of the clamp nut with the center housing. The ferrule is normally formed as a split cylinder as indicated by gap 50 so that its diameter can be modified relatively easily. Carrier 44 is employed to provide a smooth bearing surface for ferrule 45 to allow rotation of the ferrule with respect to the clamp nut so that the cable will not be gripped and twisted when the connector assemblies are tightened together.

The cable itself has been omitted from FIG. 1 for purposes of clarity. Its appearance is conventional and it would only serve to visually confuse the connector if shown in either FIG. 1 or FIG. 2. However, FIG. 4 shows the cable and connector fully assembled.

Assembly of this connector together and to one end of a properly prepared co-axial cable comprises several steps. The outer surfaces of the entry barrel and the clamp nut normally have a regular geometric shape such as a hexagon, to facilitate threaded engagement by means of wrenches. The cable is prepared with the center conductor extending approximately one and three eighths inches beyond the insulation and the substantially rigid jacket, the jacket typically being a conductive metal tube. Clamp nut 42 is slid loosely over the cable with the cable center conductor extending to the left as viewed in FIG. 1. The prepared cable end is then engaged with center housing 24. Mandrel 32 is formed with a beveled external surface 53 to facilitate its entry between the cable jacket and the central insulation. When the cable is inserted such that its insulation abuts end 38 of support insulator 31, the cable jacket will be inserted well within the center housing at approximately the location of O-ring 25 between the mandrel and inside the right end of the housing. The center conductor then extends through support insulator 31 and collar 26. At this point, the cable center conductor extends leftward from center housing asembly 23. Entry barrel assembly 11 is then coupled to the center housing by inserting the cable center conductor into chuck 17 and engaging threads 34 of the center housing with threads 22 of the entry barrel. When the assemblies are in this position, collar beveled surface 36 engages beveled surface 35 on the chuck and causes the chuck to positively grip the center conductor. In order to positively engage the cable jacket, threads 46 of clamp nut 42 and threads 47 of center housing 24 are then engaged and tightened so that center housing bevel 51 engages ferrule bevel 52 squeezing ferrule 45 radially inwardly to tightly grip the jacket of the cable between the ferrule and supporting mandrel 32. O-ring 43 provides a seal between the clamp nut assembly and the cable when the cable is coupled to the clamp nut and center housing assemblies. When all three assemblies are tightened together, the connector is completed and adapted to be coupled to an external device as desired, such as by means of threads 21 on entry barrel 12.

Figure 2:
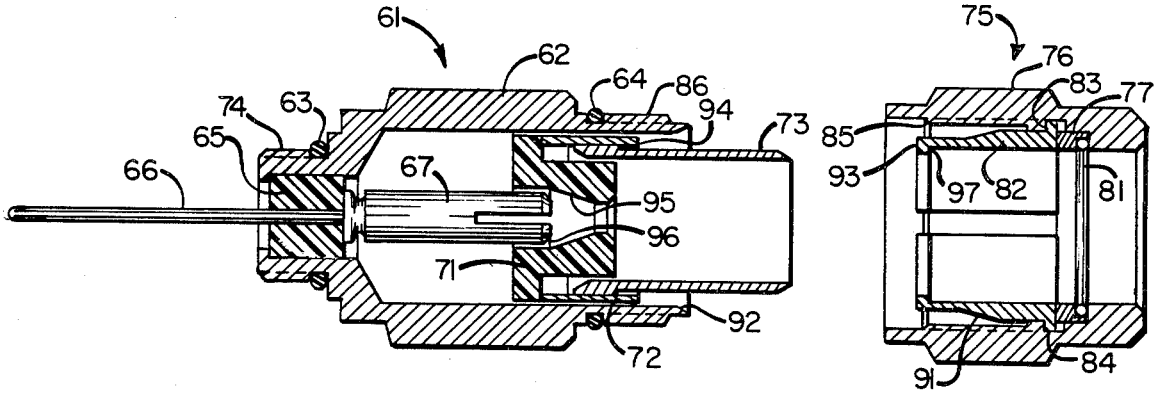
FIG. 2 is an exploded sectional view of the co-axial cable connector configured as a coupler constructed in accordance with the present invention.
Figure 3:
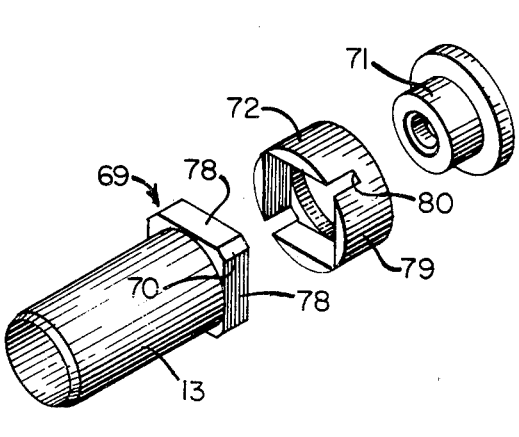
FIG. 3 is a perspective view of the collar, pusher and mandrel assembly of the connector.
Figure 4:
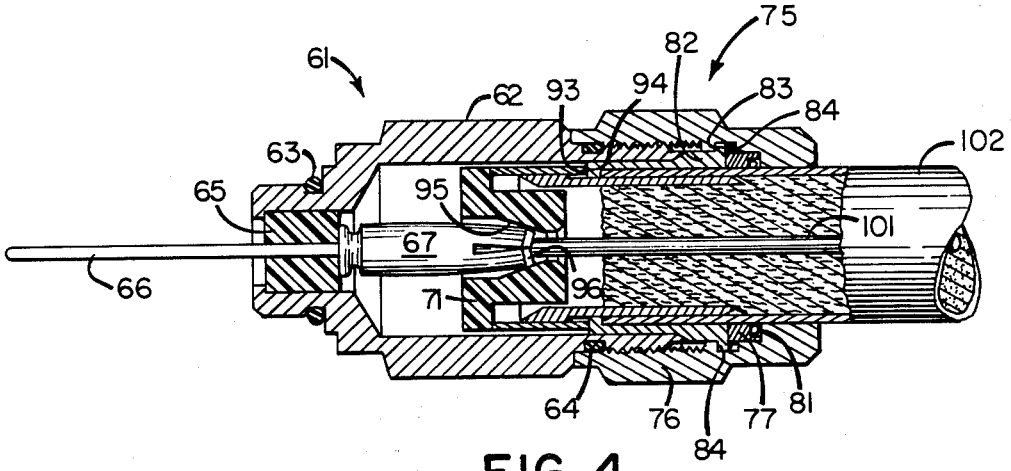
FIG. 4 is a sectional view of the connector of this invention assembled to a cable end.

The connector of the present invention is shown in FIGS. 2–4. Entry barrel assembly 61 is comprised of entry barrel 62, O-rings 63 and 64, insulator 65, terminal 66, chuck 67, collar 71, pusher member 72 and supporting mandrel 73 having a base 69. The terminal 66 and chuck 67 are normally one electrically conductive piece of substantially rigid material and are press fit into insulator 65 which assembly is then press fit into entry barrel 62. Note that the left end of barrel 62 is formed with threads 74 to mate with a conventional housing entry port (not shown). The coupling of entry barrel assembly 61 with such an entry port is sealed by O-ring 63. Pusher member 72 is a slotted device as shown in more detail in FIG. 3 and relatively loosely fits over base 69 of mandrel 73. The pusher member is generally cylindrical with tabs 79 alternating with slots 80. Base 69 of supporting mandrel 73 may be thought of as being formed from a cylinder or disc. Surfaces 78 are formed by removing material from the disc along chords with respect to the circumference of the disc. As shown in FIG. 3, these chords are substantially tangential to the outside surface of cylindrical supporting mandrel 73 but that is not a necessity. Surfaces 78 are spaced by short lands 70 which are preferably arcuate or circumferential. Collar 71 and pusher member 72 are loosely assembled onto mandrel 73. Mandrel 73 is press fit into entry barrel 62 with lands 70 tightly engaging the inner surface of the barrel. The pusher member and collar are confined within the barrel by the mandrel and the chuck as shown in the drawing. Relative axial motion of the collar and pusher member the mandrel and the chuck of about one sixteenth inch (1.5875 mm) is contemplated, although it could be slightly more or less.

In order for pusher member 72 to be able to move with respect to mandrel 73, it is necessary that the outside diameter of the pusher member be smaller than the outside diameter of base 69 of the mandrel so that lands 70 can engage the inner surface of barrel 62 while the pusher member moves freely longitudinally.

Clamp nut assembly 75 is comprised of clamp nut 76, carrier 77, O-ring 81 and ferrule 82. The carrier and O-ring are placed in the clamp nut while the ferrule, which is preferably a slotted cylinder, is snapped into the clamp nut, shoulder 83 of the ferrule being seated beneath shoulder 84 of the clamp nut. The diameter of ferrule shoulder 83 is such that the ferrule is freely rotatable within the clamp nut while is it prevented from any substantial longitudinal movement. The purpose of carrier 77, which is captured by the ferrule, is the same as carrier 44 in FIG. 1.

To assemble this connector to a prepared end of a cable, the clamp nut assembly is slid over the end of the cable which has a center conductor extending about one inch beyond the insulation and jacket of the cable. This is a shorter extension than is required of the FIG. 1 connector and results from the fact that the present connector is both simpler and somewhat shorter than the prior art connector. Unlike the connector of FIG. 1, the clamp nut does not pass completely over the end of the cable. For the coupling configuration of FIG. 2, the entry barrel would normally be tightly mounted to the entry port of a box such as an amplifier or other terminal device by means of threads 74. Internal shoulder 97 at the end of ferrule 82 engages the cable jacket so that the cable end and the clamp nut are assembled to the entry barrel assembly together (see FIG. 4). The clamp nut and the end of the cable are then inserted onto entry barrel assembly 61 such that mandrel 73 is inserted between the jacket and the insulator of the cable as discussed with respect to the connector of FIG. 1. As the two major assemblies are coupled together, the cable end proceeds leftward into the entry barrel assembly and the center conductor extends through collar 71 into chuck 67. The clamp nut is screwed onto entry barrel 62 so that the internal threads 85 of the clamp nut engage external threads 86 of the entry barrel. When the clamp nut is nearly fully tightened, annular surface 93 on the left end of ferrule 82 engages annular surface 94 on the right end of pusher member 72 to force the pusher member and collar 71 axially leftwardly as viewed in FIG. 2. This motion causes beveled surface 95 of the collar to engage beveled surface 96 of the chuck and close the chuck tightly around the center conductor of the cable. At about the same time or immediately thereafter, beveled surface 92 on entry barrel 62 engages beveled surface 91 on ferrule 82 and the ferrule is squeezed radially onto the cable jacket to positively hold the cable between the ferrule and the supporting mandrel. The completed assembly, with cable, is shown in FIG. 4. Because of configuration of the mating portions of pusher member 72 and supporting mandrel 73, that is, tabs 79 spaced by slots 80 with lands 70 extending into those slots, only longitudinal motion is imparted to collar 71 to close chuck 67. Since no rotational torque is applied to the collar or chuck upon tightening of clamp nut 76, there is no possibility of any twisting force being applied to the center conductor 101 of the cable. The connector is so constructed that the center conductor is tightly gripped by the chuck at the same time as, or just before, the final closing of ferrule 82 onto cable jacket 102, which occurs at the end of the travel of the clamp nut with respect to the entry barrel. As can be seen from FIG. 2, beveled surfaces 91 and 92 will close the ferrule relatively quickly as the clamp nut moves to the left. The connection between the clamp nut and the entry barrel is sealed by O-ring 64.

O-ring 81 provides a seal for the cable jacket and ferrule 82 engages the end of the jacket. Carrier 77 and shoulders 83 and 84 provide metal-on-metal bearing surfaces to permit relative rotational motion between clamp nut 76 and the ferrule as the clamp nut assembly is coupled to the entry barrel assembly. Thus there is no torque applied to cable jacket 102 as the clamp nut is threaded onto the entry barrel. With respect to ballooning of the jacket which could be caused by the prior art connector, it will be immediately apparent that such an effect is not possible with the present connector. If anything, shoulder 97 might move slightly away from the end of the cable jacket upon final assembly, rather than tending to compress it. However, experience has shown that the cable jacket generally stays seated against shoulder 97 as shown in FIG. 4.

Figure 5:
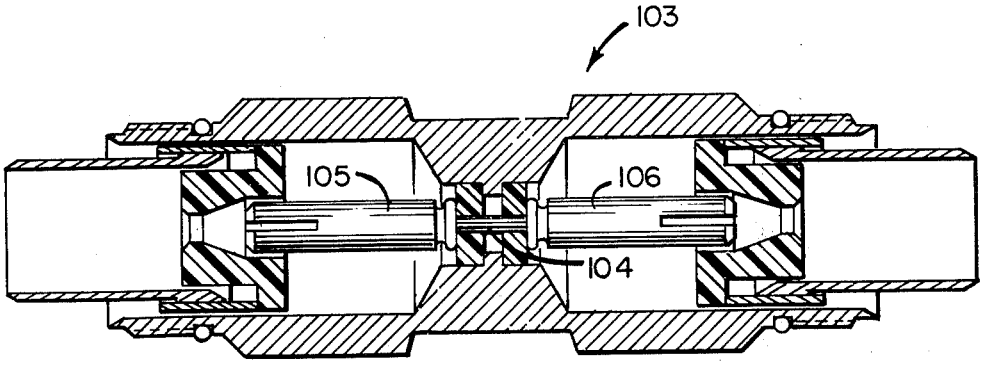
FIG. 5 is a sectional view of the connector of the invention used in a cable splice.

An alternative embodiment is shown in FIG. 5 where the clamping structure of the invention is part of a splice assembly. Entry barrel 103 is a single tubular member normally having a hexagonal outer surface and having a center conductor 104 with chucks 105, 106 on either end thereof. While this figure shows only the double ended entry barrel, the rest of the structure including the collar, pusher member and supporting mandrel, as well as the clamp nut assembly, will be the same as shown in FIG. 2.

As a further alternative, one end of entry barrel 103 could be smaller than the other, with a commensurate change in the size of the chuck. Such a splice would also function as a size adapter so that cables of different sizes could be spliced.

The advantages of this invention over the previous connector are now evident. The present connector comprises only 12 individual parts as compared with 16 of the connector of FIG. 1, and there are only two major assemblies as compared with the FIG. 1 connector which has three major assemblies. Cable preparation is easier in that the center conductor need extend beyond the insulation and jacket by only one inch (25.4 mm) instead of one and three-eighths inches as has been necessary with prior art connectors. Furthermore, the present connector is more reliable than prior art connectors because only one element need be tightened to another instead of there being two such connections to be tightened as the case with the FIG. 1 connector. Further, the necessity of keying of the prior art device is eliminated in this connector. In comparison with the FIG. 11 assembly where the cable had to be mounted to the center housing assembly and tightened by the clamp nut and the center housing assembly then had to be connected to the entry barrel assembly to make the connection to the center conductor, the present invention requires only two operations. The cable is inserted into the entry barrel assembly and when the clamp nut assembly is tightened onto the entry barrel, the jacket of the cable is gripped at about the same time that the telescoping action of the collar 71 causes the chuck to positively grip the center conductor of the cable.

With respect to materials, insulative members 65 and 71 are typically made of a plastic such polyethylene and the remaining parts, except for the conventional O-rings, are made of a substantially rigid metal such as aluminum, which are machined. The terminal and chuck may be made of some other relatively rigid metal particularly adapted to the requirements of the device.

Of course, the materials from which the elements are made is not important to the invention.

It is likely that, in view of the above description, modifications and improvements will occur to those skilled in the art which are within the scope of this invention.

What is claimed is:

1. A connector for co-axial cable, the cable having a substantially rigid electrically conductive jacket, a center conductor, and electrical insulating means therebetween, said connector comprising:

an entry barrel assembly comprising:

an entry barrel having at least one open end;

electrically conductive chuck means within said entry barrel and opening toward said open end;

cylindrical mandrel means fixed in said entry barrel and extending outwardly from said open end thereof;

pusher means loosely engaging said mandrel means and axially movable with respect thereto;

electrically insulative collar means positioned between said chuck means and said pusher means and longitudinally movable in said entry barrel; and cooperative means on said chuck means and on said collar for closing said chuck means upon engagement of said chuck means by said collar means pursuant to axial motion of said collar means toward said chuck means;

a clamp nut assembly comprising:

a clamp nut having a substantially open ended cylindrical configuration; and a ferrule mounted within said clamp nut; and cooperative means on said entry barrel assembly and said clamp nut assembly to grip the jacket of said cable;

whereby upon engagement of said entry barrel and clamp nut assemblies, said cooperative chuck closing means closes on the center conductor and said cooperative jacket gripping means grips the cable jacket.

2. The co-axial cable connector recited in claim 1 wherein:

said entry barrel is an elongated member open at each end;

said chuck means is located within each said open end and opening toward each said open end;

said cylindrical mandrel means extends outwardly from each said open end;

said pusher means loosely engages each said mandrel means;

said collar means is positioned between said chuck means and said pusher means in each said open end; and said cooperative means is on said chuck means and on said collar means in each said open end.

3. The co-axial cable connector recited in claim 1, said entry barrel further comprising a terminal extending axially from the other end of said entry barrel.

4. The co-axial cable connector recited in claim 3 and further comprising insulator means substantially closing said other end of said entry barrel, said terminal being connected to said chuck means and extending through said insulator means.

5. The co-axial cable connector recited in claim 1 wherein said clamp nut is formed with an internal shoulder and said ferrule is formed with a radially outwardly extending shoulder, said ferrule being substantially cylindrical in shape and having a longitudinal slot extending throughout the entire length thereof whereby the diameter of said ferrule may be modified, the outer diameter of said ferrule shoulder being larger than the inner diameter of said clamp nut internal shoulder, whereby said ferule can be squeezed together to reduce its diameter and snapped into place within said clamp nut and is rotatable therein.

6. The co-axial cable connector recited in claim 1 or 5 wherein said cooperative jacket gripping means comprises an external beveled surface on said ferrule and an internal beveled surface at said open end of said entry barrel, said beveled surfaces on said ferrule and said entry barrel being in cooperative mating relationship when said clamp nut is engaged with said entry barrel whereby the diameter of said ferrule is reduced when said clamp nut is tightened on said entry barrel.

7. The co-axial cable connector recited in claim 1 wherein said mandrel means is formed with a relatively thin cylindrical portion extending from within said entry barrel outwardly beyond said open end and an enlarged base portion having spaced bearing surfaces in interference fit with said entry barrel.

8. The co-axial cable connector recited in claim 7 wherein said relatively thin cylindrical extending portion of said mandrel means is adapted to be inserted between the insulating means and the jacket of said cable.

9. The co-axial cable connector recited in claim 7 wherein said pusher means has a substantially cylindrical configuration with longitudinal slots extending from one end thereof a distance less than the length of said cylinder thereby forming circumferentially spaced tabs, wherein said slots of said pusher means engage said bearing surfaces of said mandrel means, said pusher means engaging said mandrel means in a telesopic fashion with said tabs overlying said base portion of said mandrel means.

10. The co-axial cable connector in claim 1, 7 or 9 wherein said collar means has an axial opening, said cooperative chuck closing means is formed with an internal beveled surface in said axial opening, said chuck means is formed with a plurality of spaced fingers, each having an externally beveled surface, whereby upon axial movement of said collar means toward said chuck mens, engagement of said cooperative beveled surfaces causes said chuck means to close.

11. The co-axial cable connector recited in claim 10 wherein said ferrule engages said pusher means upon engagement of said clamp nut assembly with said entry barrel assembly thereby moving said pusher means and said collar longitudinally toward said chuck means.

12. The co-axial cable connector recited in claim 10 wherein said chuck means is adapted to positively retain the center conductor of said cable when said jacket is gripped by said cooperative gripping means.

13. The co-axial cable connector recited in claim 10 wherein said collar means and pusher means are confined within said entry barrel between said chuck means and said mandrel means, said collar means and pusher means being longitudinally movable within said entry barrel approximately one sixteenth inch (1.5875 mm).

* * * * *

UNITED STATES PATENT AND TRADEMARK OFFICE

CERTIFICATE OF CORRECTION

PATENT NO. : 4,346,958
DATED : Aug. 31, 1982
INVENTOR(S) : Clayton H. Blanchard

It is certified that error appears in the above—identified patent and that said Letters Patent is hereby corrected as shown below:

Column 4, line 62, "member the" should read --member between the--.

Column 5, line 53, "FIG. 4. Because" should read --FIG. 4. Because--
(Because... should start new paragraph).

Column 6, line 51, "FIG. 11" should read --FIG. 1--.

Signed and Sealed this

*Nineteenth* Day of *April 1983*

[SEAL]

*Attest:*

GERALD J. MOSSINGHOFF

*Attesting Officer*

*Commissioner of Patents and Trademarks*